US005381779A

United States Patent [19]

Shelton

[11] Patent Number: 5,381,779

[45] Date of Patent: Jan. 17, 1995

[54] BALLOON THRUSTER

[76] Inventor: Allen E. Shelton, 1408 Maenpah Way, Las Vegas, Nev. 89106

[21] Appl. No.: 123,631

[22] Filed: Sep. 16, 1993

[51] Int. Cl.[6] ..... A63H 33/30; A63H 37/00

[52] U.S. Cl. ..... 124/77; 244/31; 124/56; 124/74; 406/191; 446/475

[58] Field of Search ..... 244/31, 63; 124/56, 124/71, 77, 73; 406/191; 222/637, 5; 446/475, 176, 178

[56] References Cited

U.S. PATENT DOCUMENTS

| | | | |
|---|---|---|---|
| 2,129,489 | 9/1938 | Brown | 124/56 |
| 2,225,702 | 12/1940 | Lyon | 124/56 |
| 2,895,693 | 9/1956 | Portias . | |
| 3,068,179 | 6/1959 | Farnsworth . | |
| 3,334,676 | 8/1967 | Girard . | |
| 3,465,742 | 9/1969 | Herr | 124/77 |
| 3,680,863 | 8/1972 | Wallace et al. | 124/56 |
| 3,855,988 | 12/1974 | Sweeton | 124/56 |
| 3,938,272 | 2/1976 | Ditto et al. | 124/56 |
| 4,564,159 | 1/1986 | Hill . | |
| 4,586,456 | 5/1986 | Forward . | |
| 5,149,290 | 9/1992 | Reveen | 124/74 |

FOREIGN PATENT DOCUMENTS

| | | | |
|---|---|---|---|
| 0252338 | 1/1988 | European Pat. Off. | 406/191 |
| 829682 | 9/1938 | France | 124/77 |
| 868418 | 2/1953 | Germany | 446/475 |
| 364723 | 11/1962 | Switzerland | 446/475 |

*Primary Examiner*—Galen L. Barefoot
*Attorney, Agent, or Firm*—Quirk & Tratos

[57] ABSTRACT

A balloon distribution system that utilizes balloons retained within an elongated, tubular storage area. Upon receipt of a signal from a remotely located controller, the previously-placed inflated balloons are propelled from the storage container, and float down upon the people gathered below. The tubular body is mounted above the crowd in a manner such that the open end of the tube is slightly elevated in comparison with the adjacent section of the tubular body, preventing the stored balloons from spilling from the tube. A thruster housing is attached to the closed end of the tubular body, and the housing terminates in discharge face having a plurality of outlet nozzles extending into the cavity within the tubular body. A motor and fan supply the airflow, which flows through the thruster housing and into the tubular body through the plurality of nozzles. The motor is actuated via a signal received from a remotely mounted controller.

17 Claims, 2 Drawing Sheets

BALLOON THRUSTER

FIELD OF THE INVENTION

The present invention relates to a balloon conveyance system, and more particularly, to a device and method for remotely distributing inflated balloons over a wide area.

BACKGROUND OF THE INVENTION

Releasing a multitude of balloons from the ceiling of a convention hall or banquet room has become an extremely popular means for celebrating a significant or festive moment. Typically, the balloons are inflated and held within mesh bags, with the bag opening held together by a drawstring. The filled bags are then typically mounted to the ceiling of the "party" room, with a pull string extending from the bag drawstring down to a height where someone, such as the emcee, may pull on the string to release the balloons at the appointed time. This arrangement, although widely used, entails many drawbacks and headaches associated with the setup of the balloon bags, and mishaps at the time of release.

As an initial problem, the balloon bags are typically custom-sized, and must be sewn together in virtually a hand-tailored manner. Once completed, the bag is filled with inflated balloons, normally one balloon at a time. The filled bag is then raised to the ceiling, and manually affixed thereto with eye hooks or the like. The drawstring must then be fed along the ceiling and down a wall to an appropriate location for the operator to grasp, involving still further installation of eye hooks or the like. Additionally, while there is an obvious advantage to keeping the mechanics of the balloon bag release process hidden from the crowd, only so much circuity of the drawstring routing is possible.

In addition to making the installation of a balloon bag a tedious process, by requiring much of the work to take place with the balloon bag hoisted into position next to the ceiling, there is a continual risk of serious injury to the installers. Furthermore, the bags tend to be damaged in use, and are thus not reusable, in addition to the time involved for tearing down the bag and drawstring and associated eye hooks.

Lastly, almost to add insult to injury, after all of the attendant problems associated with installing the bag, there is a chance that the release "knot" will not release. This leaves the balloons within the bag at the critical moment, as the party or convention looks expectantly skyward.

Another drawback with prior balloon dropping systems is their relative awkwardness in mounting around ceiling objects and other obstacles. Specifically, in the case where there is a large ceiling fixture, such as a centrally-located chandelier, the off-center mounting of the balloon bag results in a less desired balloon distribution pattern over the crowd below. In other instances, the room or hall may be relatively short in height and thus the balloon bag must be held quite close to the ceiling and fairly spread out. This involves some additional designing of the bag and attendant mounting problems. Perhaps most disadvantageously, the balloon bags must be in plain sight of the attendees of the event in order for the balloons to drop over the top of them. This tends to ruin the element of surprise for the organizers.

Accordingly, the present invention overcomes the drawbacks of prior balloon dropping systems.

SUMMARY OF THE INVENTION

The present invention provides a system for distributing balloons from a height, such as a ceiling, which does not require the use of a pull-string. The balloon distribution system generally comprises an elongated balloon thruster that propels balloons from an interior cavity through an open end after reception of a remote command signal. The elongated balloon thruster generally comprises a wide tubular body within which inflated balloons are stored, the tubular body being slightly inclined so that the balloons are held within by gravity prior to being expelled. The higher end of the tubular body is open while the lower end is closed by a balloon thruster housing.

The thruster housing forms an air distribution chamber that forces air through a plurality of nozzles extending from a face of the housing within the tubular cavity. Forced air through the nozzles causes the balloons to migrate upwards and out through the open end of the tubular body. To lessen the possibility of balloon "jams" within the tubular cavity, a certain agitation of the individual balloon is obtained by using a plurality of individual air nozzles. The tubular body incorporates a rigidifying member that provides a radial stiffness so as to retain the tubular shape when the forced air is turned on.

In one embodiment, the tubular body comprises a flexible outer skin surrounding a coil shaped central rigidifying member. The outer skin is sealingly attached to the outer surface or nozzle end of the thruster housing to form the cavity within the tubular body. The forced air may be supplied by a fan that is affixed to the thruster housing and supplies air through a central inlet in the rear end. The fan is preferably driven by an electric motor, and includes a switch that is activated by signals through a receiver. Alternatively, the fan motor may be connected to a switch mounted within reach of the operator, and then connected to the fan motor with a wire.

A particularly advantageous feature of the present invention is the flexibility of the tubular body. Specifically, the construction of the tubular body with an inner coil and an outer skin renders it highly flexible in an axial direction for compression and storage. A further advantage of the flexibility of the tubular body is the capability to bend around obstacles. One example is for the tubular body to be hidden behind a wall with the open end extending slightly above the wall and angled into the room so that the entire apparatus is substantially hidden but the balloons are directed over the top of the wall.

Another aspect of the present invention is an improved procedure for distributing balloons over a wide area from a height. The procedure involves expelling the balloons out of an open end of a container under the control of a remote switch. Preferably, the procedure comprises expelling the balloons from an elongated container having an open end and a closed end with forced air input through the closed end. More preferably, the forced air is introduced through the closed end through a plurality of inlet nozzles in order to agitate and reduce the instances of clogging of the elongated container.

BRIEF OF THE DRAWINGS

DESCRIPTION OF THE PREFERRED EMBODIMENTS

Figure 1:
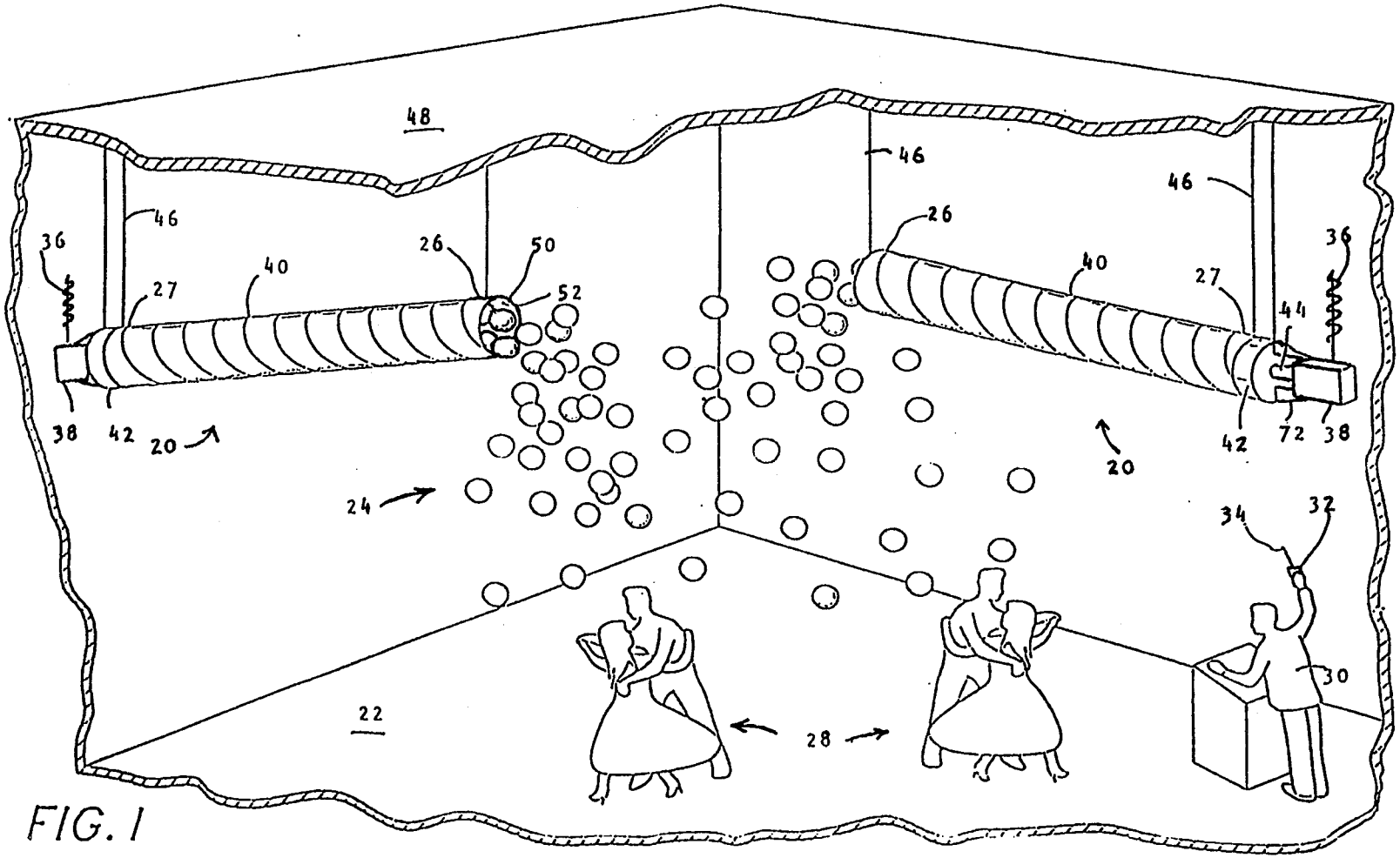
FIG. 1 is a schematic view of the balloon thruster system of the present invention as installed in a ceiling of a convention hall.

FIG. 1 shows the interior of a convention hall, banquet room or ballroom in which the balloon thruster of the present invention is shown distributing a plurality of balloons over the participants. Although the present invention is designed to propel balloons out of a container for distribution over an area, other articles such as ping pong balls, confetti, and other similar elements having a relatively light weight-to-volume ratio may be incorporated into a thruster utilizing the inventive concepts of the present invention with only slight modifications. Preferably, however, the balloon thruster works best with inflated balloons for distribution at a certain moment over a crowd of convention-goers or revelers, upon command from a remotely-located switch.

As shown in FIG. 1, a plurality of balloon thrusters 20 may be deployed around a room 22 in order to cover a wider area. A plurality of inflated balloons 24 are shown being expelled from a balloon discharge end 26 of each of a plurality of balloon thrusters 20 over a crowd of people 28. An operator 30, typically the emcee of the event, is shown with a hand-held remote controller 32 having a switch (not shown) for activating the balloon thrusters 20. 0f course, the remote controller 32 may have a switch corresponding to each individual balloon thruster 20 for selective activation. The remote controller 32 includes a transmitting antenna 34 for emitting signals that are received by an activator antenna 36, which is connected to a motor/fan housing 38 on each balloon thruster 20. The details of remote control transmitters and receivers, and the manner by which a motor can be remotely activated by such remote control systems, are well known in the art, and thus will not be described further herein. Alternatively, the motor may be actuated via a wire that extends along the ceiling and down a wall or may be permanently installed in the facility and terminate in a wall switch near the podium, providing easy access to the emcee or operator.

As a vessel for storing the inflated balloons 24 prior to their release, the balloon thruster 20 includes an elongated, tubular body 40 having the aforesaid discharge end 26, a thruster housing 42 attached to a forced air end 43 of the tubular body 40, a blower neck 44, and the aforesaid motor fan housing 38 attached to the neck 44. A plurality of guy wires 46 are typically used to suspend the balloon thrusters 20 from a ceiling 48. The guy wires 46 may be attached to the ceiling joists or other structural support in the ceiling by conventional means and may loop around the tubular body 40 or, by fasteners, attach to supporting points provided on the tubular body 40, both techniques being well known in the art.

Although it is possible to provide a temporary closing mechanism for the discharge end 26, to lessen the chances for miscues due to mechanical malfunctions and the like, the discharge end 26 preferably takes the form of an unrestricted opening 50. Consequently, the guy wires 46 support the balloon thrusters 20 in a manner that slightly elevates the discharge end 26 in comparison with the remainder of the tubular body 40. This slight positive angle to the horizontal enables the inflated balloons to remain within the tubular body 40. In addition, variations in this elevation angle are possible, permitting the balloons to follow certain pre-selected trajectories as they emerge from the tubular body 40.

In accordance with the preferred embodiment, the loaded balloon thrusters 20 utilize gravity to retain the plurality of balloons 24 within a balloon-storing cavity 52 formed within the tubular body 40. Whether by switch or, as is shown in FIG. 1, by the hand held remote controller 32, once the operator 30 initiates the flow of forced air through the forced air end 43, and into the tubular body 40, the balloons 24 become entrained in the airflow, and are expelled from the open discharge end 26.

Figure 2:
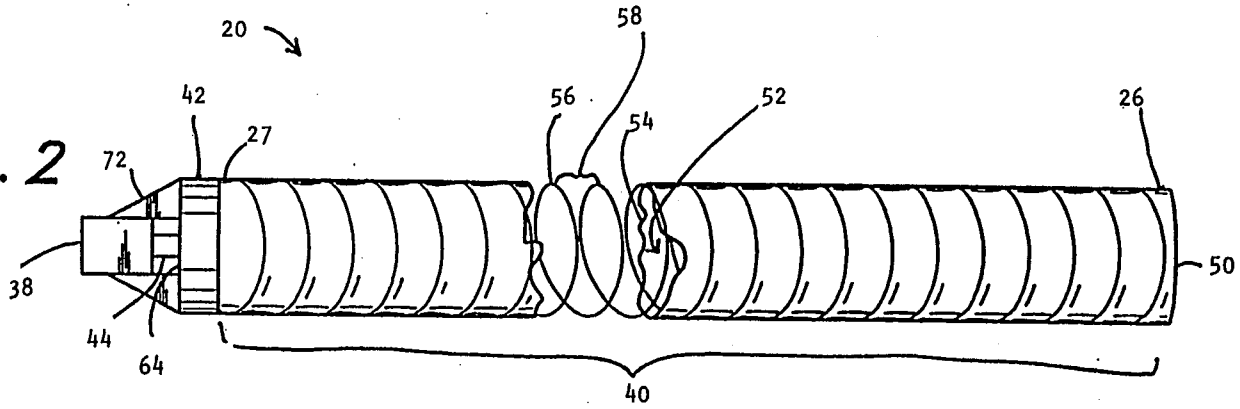
FIG. 2 is a side elevational view, partially cut-away, showing the preferred balloon thruster of the present invention.
Figure 3:
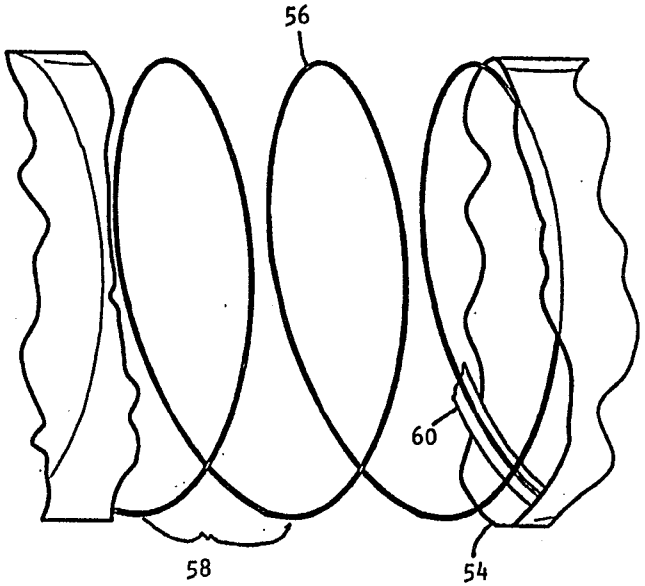
FIG. 3 is a detailed view of the cutaway portion of the balloon thruster of FIG. 2.

Now referring to FIGS. 1–3, the construction of the balloon thruster 20 is shown in more detail. The major part of the balloon thruster 20 is the elongated tubular body 40 that is comprised of a flexible outer skin 54 and a radially stiff inner coil 56. It has been discovered that some sort of radial support is necessary for the tubular body 40 in order to prevent the inward collapsing of said body upon the flow of forced air through the tubular body 40.

Rather than construct the entire tubular body 40 of a solid or rigid material, the present invention combines the relatively thin flexible outer skin 54 and the inner coil 56 in order to reduce the weight of the balloon thruster 20 and thus reduce the strength requirements of the associated fasteners and guy wires 46. Although not specifically shown in FIG. 2, the inner coil 56 extends the entire length of the tubular body 40 from the thruster housing 42 to the discharge end 26. The inner coil 56 defines an interior cylindrical volume forming the balloon-storing cavity 52, wherein the inflated balloons 24 are resident, prior to expulsion.

The preferred construction of the tubular body 40 utilizes a helical or individual "hoop" inner coil 56, permitting the tubular body 40 to be compressed without material deformation into a smaller package for storage and shipping. The inner coil 56 in many ways acts as a large spring, permitting the inner coil 56 and the flexible outer skin 54 to be compressed and then spring back to the preferred length of the tubular body 40. In one embodiment, the tubular body 40 has a length of approximately 20 feet, a diameter of approximately 3 feet, and the inner coil 56 is constructed of galvanized wire hoops with each wire loop being approximately one foot apart, for a total of 20 loops. Preferably, the coil wire is constructed of galvanized music wire of approximately ⅛ inch diameter thickness. The inner coil 56 provides a minimum amount of axial stiffness to extend the tubular body 40 out to its full length while still being capable of compression.

As best shown in FIGS. 2 and 3, the inner coil 56 is relatively loosely wound, providing an interstice 58 between each coil, permitting the tubular body 40 to be compressed into a shortened configuration. In addition, the coil-interstice combination provides for an inherent flexibility of the inner coil 56 and outer skin 54. This flexibility in turn permits the tubular body 40 to be easily bent or shaped into various angles and curves in order to conform to irregular ceilings, or to skirt around lighting or other fixtures of the facility in which the balloon thruster 20 is to be installed. For example, the balloon thruster 20 may have to be serpentined around light fixtures or chandeliers within a convention hall or banquet room.

In another possible scenario, it may be desirable to hide the majority of the balloon thruster and only have the discharge end 26 and the opening 50 barely visible from the room. In such situations, the balloon thruster 20 may have to be hidden behind a partition or wall, and bent so that the opening 50 points into the room. Thus, it can be seen that the flexible nature of the tubular body 40 provides many advantages over prior balloon distribution systems.

With reference to the construction of the tubular body 40 as shown in FIG. 3, the present invention incorporates a flexible strip 60, or a plurality of end-to-end strips of flexible material (not shown), that overlies the inner coil 56 and is attached to the inner surface of the outer skin 54 on each lateral side of the inner coil 56. In this manner, the strip 60 may be likened to a piece of adhesive tape or simply a strip of fabric similar to the fabric of the outer skin 54 that forms a pocket between the strip and the outer skin for the coil 56. When attached to the inner surface of the outer skin 54, the strip 60 presents a smoothed, inner surface for the cavity 52 in order to facilitate the migration of balloons through the tubular body 40 and towards the discharge end 26 upon actuation of the forced air.

Other arrangements are possible in order to smooth the inner surface of the cavity 52, such as constructing the entire tubular body 40 of a single rigid piece (although this may be disadvantageously heavy), or providing a second, inner skin (not shown) of material along the entire length of the tubular body 40. Likewise, other arrangements for providing a radial stiffness to the tubular body 40 may be incorporated, such as utilizing rings that are coupled together axially, the helical coil 56 thus representing only a preferred embodiment. In short, the beneficial aspects provided by the preferred construction of the tubular body 40 include lightness in weight, a minimum axial stiffness, a minimum radial stiffness and a sufficient length and diameter to contain a plurality of inflated balloons 24, typically 75 to 100 for most installations, prior to their expulsion from the tubular body 40.

Referring once again to FIG. 1, although guy wires 46 are shown supporting the balloon thrusters 20 from the ceiling 48, it is contemplated that the thruster housing 42 may be mounted to a wall and the tubular body 40 extend into the room therefrom, in cases where the ceiling is either too high or non-existent, as for "open air" events. In this situation, a number of arrangements may be used to support the elongated tubular body 40 extending from a wall. One possible solution is to attach the guide wires from the wall at an angle to points along the tubular body 40. In another solution, internal ribs (not shown) may be provided extending from the forced air end 43 out to the discharge end 26 to provide a minimum level of cantilever support. Due to the lightweight construction of the tubular body 40 itself, as well as with respect to the balloons within, it is contemplated that one or more ribs (not shown) attached rigidly to the thruster housing 42 may be sufficient to fully support the extended tubular body 40.

Figure 4:
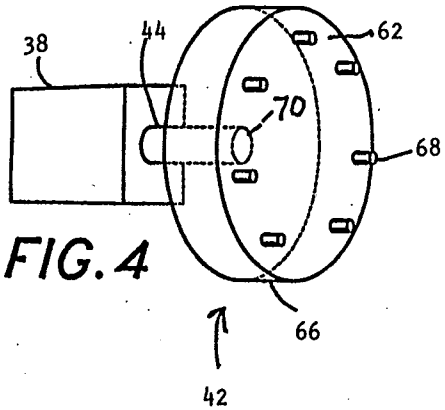
FIG. 4 is a perspective view, with portions shown in phantom, of a thruster housing incorporated into the balloon thruster of the present invention.

The forced air end 43 of the balloon thruster 20 will now be described in detail with reference to FIGS. 2 and 4. The thruster housing 42, shown separated in FIG. 4, generally comprises a hollow, rigid, disk-shaped chamber having a discharge face 62 and an outer face 64. The outer skin 54 of the tubular body 40 attaches either to the outer peripheral regions of the discharge face 62 or to the outer cylindrical surface 66 of the thruster housing 42. The flexible outer skin 54 provides an air-tight seal around the exterior of the thruster housing 42, and may be affixed with epoxy or other similar expedient. The inner coil 56 may also be affixed to the thruster housing 42, but this is not a critical requirement.

A plurality of tubular nozzles or stems 68 extend in a spaced pattern from the discharge face 62 into the balloon-storing cavity 52 of the tubular body 40. The passage of air through the tubular nozzles 68 injects the forced air into the balloon-storing cavity 52, propelling the inflated balloons 24 along the length of the tubular body 40, and ultimately, out the opening 50.

The forced air is preferably generated in a conventional manner using a fan mechanism (not shown) provided within the motor/fan housing 38. The forced air output of the fan (not shown) then passes via the blower neck 44, and through a central aperture 70 in the outer face 64 of the thruster housing 42. The thruster housing 42 thus provides a chamber for receiving the force air from the central aperture 70 and then distributing the air out the plurality of tubular nozzles 68. Depending upon the size of the motor and fan (neither shown), one or more support wires or braces 72 may be provided to support the motor/fan housing 38 from the end of the thruster housing 42, reducing the loading stress on the neck 44.

In a preferred embodiment, the thruster housing 42 has a diameter of approximately three (3) feet and a depth of approximately eight (8) inches. The depth of the thruster housing 42 may be less than eight (8) inches, but is preferably no more than ten (10) inches. At greater depth values, the increased internal volume requires more time to build up a sufficient pressure within the thruster housing 42 to overcome the air flow resistance created by the tubular nozzles 68 and begin the flow of air into the tubular body 40.

The thruster housing 42 is preferably constructed of a rigid plexiglass or other similar material, and may be fabricated in different sizes and shapes, depending on the usage or to reduce manufacturing costs. For example, it is possible to construct a polygonal outer circumference, such as a hexagon, and avoid the increased costs required to fabricate a circular plastic cylinder for the thruster housing 42. In addition, the flexible outer skin 54 can easily be attached to such a polygonal shape, in a similar, air-tight manner as in the preferred, circular embodiment.

In FIG. 3, seven tubular nozzles 68 are shown to be distributed in a ring-shaped manner over the discharge face 62, spaced radially inward from the outer periphery of the thruster housing 42. For reasons that are not entirely understood, but are believed to be the same or similar to the mechanism by which water passing through a restriction in a river bed acts with greater force against boats and other floating objects, so too the tubular nozzles 68 appear to ease the passage of the balloons 24 through the tubular body 40. Specifically, it has been discovered that providing a plurality of air nozzles, such as the tubular nozzles 68, enhances the agitation of the inflated balloons 24 within the tubular body 40, substantially reducing, if not eliminating, the instances of tube blockage caused by the "bunching" of the balloons within the tubular body 40.

The tubular nozzles 68 extend from the discharge face 62 a sufficient distance to prevent the plurality of balloons from resting on the discharge face 62 in a manner that blocks the air passageways. Such extension of the tubular nozzles 68 is to some extent dependent upon the curvature of the balloons being used; however, such extension is preferably approximately two to three inches (2"-3") from the discharge face 62. It has been observed that, when loaded with balloons, a plurality of the inflated balloons 24 rest against the discharge face 62. By providing the extended tubular nozzles 68, the inflated balloons 24 are prevented from blocking the outlet nozzles as the nozzles project past the surface of the discharge face 62, between the "resting" balloons, and into the tubular body 40. Other configurations for providing enhanced agitation of the balloons and/or imparting a preferred velocity to the expelled balloons are contemplated, as described below.

In an alternative embodiment (not shown), a secondary inner lining may be provided within the inner coil 56. The secondary lining forms a smooth interior wall for the balloon-storing cavity 52, and also forms an annular space between the secondary lining and the outer skin 54. A number of air conduits or tubes may be run in this space between the lining and skin, and then terminated at various locations along the tubular body 40. Thus, secondary air injection ports may be provided along the length of the tubular body 40 in order to enhance the mixing or agitation of the balloons within the balloon-storing cavity 52 and prevent blockage.

As a further refinement of the secondary lining embodiment, the secondary air inlets may be angled to impart a rotational velocity to the balloons as they travel the length of the tubular body 40. For example, the secondary air inlets may be aimed at a slight tangential angle around the cavity to initiate and maintain a rotation to the balloons, resulting in a whirling or cyclone effect as the balloons exit the discharge end 26.

Alternatively, the secondary air conduits may terminate only at the opening 50, and thereby impart a preferred final velocity to the balloons, as opposed to simply allowing the balloons to be expelled and drop into the crowd by gravity. Such a final velocity may be utilized to direct the balloons over a wall or partition, as described previously, in order to more completely hide the balloon thruster 20 apparatus. A more typical situation is where a chandelier or other object is located in the exact center of a particular room, with the dance floor or other desired balloon impact area also located directly under the chandelier. In order to distribute the balloons over the central location, a preferred final velocity may be utilized to propel the balloons to the desired floor position from an off-center mounting on the ceiling.

For the preferred embodiment in FIGS. 1-4, the electric motor (not shown) required to drive the fan (also not shown) is approximately a one (1) horse-power motor. Smaller or larger motors also may be utilized, depending upon the dimensions of the tubular body 40 and the number of balloons that are to be expelled. The small motor and fan sending forced air through the blower neck 44 and into the hollow interior of the thruster housing 42 is shown as a preferred embodiment only, and a larger fan, possibly having fan blades extending to the radial exterior dimension of the thruster housing 42, may also be utilized. In addition, the forced air may be provided from a compressed air canister, in order to eliminate the necessity for electric power. Furthermore, in locations where the balloon thruster 20 is used frequently, a compressed air system may be installed in the building itself and the hose run to the outer face of the thruster housing to provide the forced air, obviating the need for the motor and fan installation.

In operation, a balloon thruster 20 of the present invention has been mounted to a ceiling 48 prior to the beginning of a convention, banquet, fiesta or other festive occasion, with a plurality of inflated balloons being contained within the open-ended tubular body 40. At the appropriate moment, the emcee/operator 30 actuates one or more switches on the remote controller 32 to start the motor and fan blades turning. The forced air through the neck 44 and the tubular nozzles 68 begins to expel the inflated balloons 24 from the opening 50 in the tubular body 40. In a short period of time, the entire group of balloons has been transported along the length of the tubular body 40 and expelled with a certain velocity from the opening 50. Depending upon the air currents in the room, the expelled balloons fall by gravity, in a generally random distribution, raining down upon the party crowd 28 below.

Although this invention has been described in terms of certain preferred embodiments, other embodiments that are apparent to those of ordinary skill in the art are also within the scope of this invention. Accordingly, the scope of the invention is intended to be defined only by the claims.

I claim:

1. A balloon distribution system for mounting to a location above an area over which balloons are to be selectively distributed, comprising:

an elongate container having a balloon discharge end and a closed proximal end, together forming a cavity suitable for receiving and retaining a plurality of inflated balloons; and a source of forced air; and a plurality of spaced apart nozzles each having a first end in communication with said forced air source and a second end substantially aligned with said elongate container at said proximal end thereof;

whereby said forced air, when in communication with said container through said plurality of nozzles, passes through said cavity and transports any balloons retained therein out through said balloon discharge end.

2. The balloon distribution system of claim 1, and further comprising:

a thruster housing at the closed end of the container containing said plurality of nozzles for distributing the forced air into the cavity.

3. The balloon distribution system of claim 1, wherein the container is an elongated tube and comprises:

an outer thin flexible skin; and an inner radially stiff support member extending the length of the elongated container.

4. The balloon distribution system of claim 3, wherein the inner radially stiff support member comprises a coil defining the cylindrical cavity within.

5. The balloon distribution of claim 4, wherein the coil is constructed of wire and has adjacent loops spaced apart to form gaps.

6. The balloon distribution system of claim 2, wherein the thruster housing comprises:

a hollow rigid member having a central inlet on a proximal face and said plurality of nozzles on a distal face opening into the cavity of the container.

7. The balloon distribution system of claim 6, wherein the outlet nozzles further comprise short stems extending into the cavity from the distal face of the thruster housing.

8. The balloon distribution system of claim 7, wherein the outlet nozzles are distributed in a generally ring pattern spaced radially inward from the outer periphery of the thruster housing.

9. The balloon distribution system of claim 1, wherein the source of forced air is a fan driven by a motor.

10. The balloon distribution system of claim 9, wherein the motor is actuated by a switch which is at a remote location, the switch and motor including means for communicating via radio waves.

11. The balloon distribution system of claim 9, wherein the motor is actuated by a switch connected physically by a wire to the motor.

12. The balloon distribution system of claim 1, wherein the source of forced air is a bottle of pressurized gas.

13. A method for distributing a plurality of balloons over an area, the method comprising the steps of:

retaining a plurality of balloons within a container having an open end by orienting the container so that the open end is at the highest point; and propelling the balloons from within the interior of the container by directing at least one airstream towards said open end of said container.

14. The method of claim 13, wherein the step of propelling the balloons further comprises:

forcing air into the container from an end opposite said open end.

15. The method of claim 14, wherein the step of forcing air further comprises:

actuating a motor to turn a fan that is mounted to said end opposite the open end of the container by actuating a switch that is at a remote location from the motor.

16. The method of claim 14, wherein the step of forcing air further comprises:

forcing air out of a plurality of nozzles within the container at said end opposite said open end in order to facilitate the agitation of the balloons as they are propelled out of the container.

17. An inflated balloon delivery system comprising:

an elongate chamber having an air inlet and an air exhaust opening;

a plurality of inflated balloons located in said chamber;

a source of forced air in fluid communication with the inlet opening of said chamber, said forced air directed along the length of said chamber from said inlet towards said exhaust opening; and a controller in communication with and selectively regulating the flow of said forced air into said chamber.

* * * * *